US009741550B2

(12) United States Patent
Haase

(10) Patent No.: US 9,741,550 B2
(45) Date of Patent: Aug. 22, 2017

(54) MASS SPECTROMETER WITH LASER SPOT PATTERN FOR MALDI

(71) Applicant: Bruker Daltonik GmbH, Bremen (DE)

(72) Inventor: Andreas Haase, Bremen (DE)

( * ) Notice: Subject to any disclaimer, the term of this patent is extended or adjusted under 35 U.S.C. 154(b) by 0 days.

(21) Appl. No.: 14/524,418

(22) Filed: Oct. 27, 2014

(65) Prior Publication Data

US 2015/0122986 A1 May 7, 2015

(30) Foreign Application Priority Data

Nov. 4, 2013 (DE) ..... 10 2013 018 496

(51) Int. Cl.
*H01J 49/16* (2006.01)
*H01J 49/00* (2006.01)

(52) U.S. Cl.
CPC ..... *H01J 49/164* (2013.01); *H01J 49/0004* (2013.01)

(58) Field of Classification Search
USPC ..... 250/282
See application file for complete search history.

(56) References Cited

U.S. PATENT DOCUMENTS 6,376,819 B1 * 4/2002 Neal ..... G01J 9/00 250/201.9
7,235,781 B2 * 6/2007 Haase ..... H01J 49/164 250/288
8,431,890 B1 * 4/2013 Haase ..... H01J 49/164 250/288
8,946,619 B2 * 2/2015 Wu ..... 250/216
2011/0114834 A1 5/2011 Choi et al.
2012/0127723 A1 5/2012 Mikhailov
2013/0056628 A1 3/2013 Holle et al.

FOREIGN PATENT DOCUMENTS

GB 2495805 A1 4/2013
WO 2013093482 A2 6/2013

OTHER PUBLICATIONS

Wen, et.al. "The Talbot effect: recent advances in classical optics, nonlinear optics, and quantum optics", Advances in Optics and Photonics 5, pp. 83-130 (Mar. 29, 2013).*
Besold et.al, "Practical limitations of Talbot imaging with microlens arrays", Pure Appl. Opt. 6, pp. 691-698 (Aug. 1997).*

* cited by examiner

*Primary Examiner* — Phillip A Johnston
(74) *Attorney, Agent, or Firm* — Benoît & Côté Inc.

(57) ABSTRACT

The invention relates to mass spectrometers with an ion source, comprising a UV laser system for mass spectrometric analyses with ionization of analyte molecules in a sample by matrix-assisted laser desorption, which, with very low energy losses, can produce a spatially distributed spot pattern with several intensity peaks of equal height, thus making it possible to achieve an optimum degree of ionization of analyte ions for any task. Such a spot pattern can be generated from the UV beam with high transverse coherence, using a combination of a lens array and a lens, provided that the lens array satisfies a mathematical condition for separation of the micro-lenses from each other (pitch) and their focal length. For example, a lens array with square or round lenses produces a pattern of nine and five spots, respectively. The lens arrays are inexpensive and do not require any lateral adjustment in this arrangement.

14 Claims, 3 Drawing Sheets

MASS SPECTROMETER WITH LASER SPOT PATTERN FOR MALDI

BACKGROUND OF THE INVENTION

Field of the Invention

The invention relates to a mass spectrometer with a laser desorption ion source, comprising a laser system for mass spectrometric analyses with ionization of the analyte molecules of a sample by matrix-assisted laser desorption.

Description of the Related Art

Over the past twenty years, two methods have gained acceptance in the mass spectrometry of biological macromolecules: matrix-assisted laser desorption and ionization (MALDI) and electrospray ionization (ESI). The biological macromolecules to be analyzed are termed analyte molecules below. In the MALDI method, the analyte molecules are generally prepared on the surface of a sample support in a solid, polycrystalline matrix layer, and are predominantly ionized with a single charge, whereas in the ESI method they are dissolved in a liquid and ionized with multiple charges. It was these two methods which made possible the mass spectrometric analysis of biological macromolecules in genomics, proteomics and metabolomics; their inventors, John B. Fenn and Koichi Tanaka, were awarded the Nobel Prize in Chemistry in 2002.

Matrix-assisted laser desorption and ionization (MALDI) has been improved enormously in recent years by switching from nitrogen lasers to solid state UV lasers with a longer service life, and in particular by using beam generation with a spatially modulated beam profile for an increased ion yield. The method of beam generation and the corresponding laser systems have been described in the equivalent documents DE 10 2004 044 196 A1, GB 2 421 352 B and U.S. Pat. No. 7,235,781 B2 (A. Haase et al., 2004) and have become known under the name "smart beam". These documents are incorporated herein by reference.

The invention in the above-listed documents is based on the finding that the ion yield from a sample volume increases greatly if the laser spots are made very small, down to around five micrometers in diameter. This means, however, that energy densities very soon reach levels at which spontaneous fragmentation of the ionized molecules occurs. On the other hand, if one remains below this limit, too few ions are generated per shot from this small sample volume. As a solution, a pattern of several spots is proposed in order to obtain sufficient ions without fragmentation. It turns out that other parameters, such as the mass resolution, are also positively affected. With the fine spot pattern, hardly any sample material is spattered, something that is always a problem for larger spot diameters with larger amounts of molten material. Preferably around five to fifteen sharply focused laser spots with a diameter of around five micrometers should be produced to generate the right number of ions in each laser shot. Each laser spot should have the same energy density, since the ion generation rate increases at roughly the sixth to seventh power of the energy density in the laser spot. If the energy density for a spot were to be increased by 50 percent, for example, the degree of ionization would increase by more than a factor of ten. The other spots of the pattern would then produce hardly any analyte ions in comparison, but would consume sample in an undesirable way.

The generation of patterns increases the ion yield per analyte molecule by far more than a factor of 10 and reduces the sample consumption accordingly; this is important especially for imaging mass spectrometry on thin tissue sections.

Since modern mass spectrometers are designed for spectrum acquisition rates of 10,000 image spectra per second and more, the generation of the spot pattern must additionally be very energy-efficient in order to obviate the need for expensive very high-performance lasers.

Generating a pattern with a few UV spots of the same energy density is not a trivial undertaking. A region with intensity peaks of equal intensity can be created with an arrangement of two matched lens arrays ("fly's eye"), (see, for example, "Refractive Micro-optics for Multi-spot and Multi-line Generation", M. Zimmermann et al., Proceedings of the 9th International Symposium on Laser Precision Microfabrication; LPM2008). In the infrared, at a wavelength of 10 micrometers, this region can comprise precisely nine spots, but in the ultraviolet, it comprises hundreds of spots. Another possibility is to use diffractive beam splitters, but their production costs are high. Since fused silica has to be used for the optical elements at these wavelengths, it is usually very expensive to manufacture appropriate beam-shaping optical devices.

A method for the energy-efficient generation of only a few UV spots of equal energy density and the associated equipment are disclosed in the equivalent documents DE 10 2011 116 405 A1, U.S. Pat. No. 8,431,890 B2 and GB 2 495 815 A (A. Haase and J. Höhndorf). These documents are also incorporated herein by reference. These documents also contain a longer introduction to the current knowledge on MALDI and describe in detail the reason for the introduction of spot patterns.

The components for equipment in accordance with these documents are relatively expensive, however, and the components used must be adjusted very precisely and reproducibly. There is still a need for low-cost methods and equipment, and particularly ones that have not to be critically adjusted. The insensitivity to adjustment becomes particularly important when several pattern generators are to be used in rapid interchange in order to match the spot patterns to the analytical task.

SUMMARY OF THE INVENTION

A mass spectrometer is proposed with a laser system which, with very low energy losses, produces not only a single spot on the sample but optionally also spatially distributed spot patterns with intensity peaks of approximately the same height, thus making it possible to achieve an optimum degree of ionization for analyte ions for any analytical task and any type of sample preparation. From a natural Gaussian profile of a UV beam from a solid state laser, for example, with very high transverse coherence, it is possible to produce a spot pattern using a combination of a single (in particular two-dimensional) microlens array and an imaging lens, where the spot pattern is generated in the focal plane of the imaging lens by the periodic phase introduced by the lens array, with the aid of a Fourier transform. Unidirectional parallel beams (0th, 1st, 2nd, n-th order) emerging from the array are united in the focal plane and generate spots whose intensities differ in height, depending on the interference conditions. Several spots of equal energy density can be produced in this way if the lens array satisfies a mathematical condition between the separation width of the lenses in the array (pitch), in at least one direction, and their focal length. It is therefore not necessary to use a fly's eye lens system with two matching lens arrays which have to be precisely aligned with each other. A hitherto unknown mathematical anomaly causes the uniform pattern with several signal peaks to occur at a UV wavelength. A pattern of nine spots is produced from a lens array with square lenses, for example, and a pattern of five spots from a lens array with round lenses. Lens arrays which do not satisfy the mathematical condition produce spot patterns with a largely non-uniform intensity. As has been described in the introduction, UV spot patterns of equal height are to date only known for large numbers of intensity peaks (hundreds of spots).

With a square lens array where the lenses in the array have a pitch of 150 micrometers with respect to each other and a beam diameter of around five millimeters, it is possible to use an imaging lens (often called a Fourier lens) to generate a pattern of three by three peaks of equal height, each separated by 33 micrometers, ideal for scanning a pixel 100 by 100 micrometers square in imaging mass spectrometry. It is possible to generate patterns with a smaller separation, for example 17 or 8 micrometers for scanning pixels with 50 or 25 micrometers edge length, by using a larger pitch.

No precision is required to adjust an individual lens array. If the lens array is shifted laterally (i.e., perpendicular to the beam path of the UV laser light), neither the position nor the intensity distribution of the pattern changes. The ratio of the diameter of the intensity peaks at a height of $1/e^2$ to the spot separation in the pattern depends on the diameter of the primary laser beam; the larger the beam diameter, the smaller the spot diameter. A Gaussian beam 1.2 millimeters in diameter at a height of $1/e^2$ results in a pattern of intensity peaks whose diameter corresponds to around one-eighth of the spot separations when the imaging is ideal, for example. The spot diameters are approximately four micrometers for peaks with a separation of 33 micrometers. The diameters of the spots can be increased in a simple way by imaging the spots of the pattern onto the sample so that they are out of focus. In other words, the image of the laser spots is shifted slightly out of the plane of the sample support that is to be bombarded.

Around the pattern (i.e., around the central laser spots with almost homogeneous intensity), further intensity peaks can occur, but their amplitude is at least a factor of three lower. If they interfere, they can be filtered out with the aid of apertures. More than 60% of the total energy of the laser beam is contained in the several prominent, central intensity peaks of the pattern. The spot pattern with intensity peaks of the same height produces an outstandingly high degree of ionization for analyte ions.

BRIEF DESCRIPTION OF THE DRAWINGS

The invention can be better understood by referring to the following figures. The elements in the figures are not necessarily to scale, emphasis instead being placed upon illustrating the principles of the invention (often schematically). In the figures, like reference numerals designate corresponding parts throughout the different views.

FIG. 1 shows only the parallel beams of −1st, 0th and +1st order. These parallel beams in different directions are transformed into the spot pattern (24, 25, 26) in the plane (5) by a Fourier lens (4). The periodically arranged diffractive or refractive elements (3) can take the form of a diffraction grating, for example. A further imaging lens (8) reconverts the spot pattern into parallel beams (9), which ultimately generate the spot pattern on the sample.

DETAILED DESCRIPTION

The invention proposes a mass spectrometer with a laser system whose main objective is to generate spatially divided spot patterns with several peaks of approximately equally high intensity on the MALDI sample with only small energy losses, where the pattern-generating elements are inexpensive and not sensitive to adjustment. In a first embodiment, which will be described further below, nine spots are generated in each case; and five spots with a second embodiment; but other patterns with other numbers of spots also seem to be possible. The diameters of the spots can be changed as desired by shifting lenses, for example. Single spots or spot patterns with more than twenty spots can also be produced, which means that an optimum degree of ionization for analyte ions can be achieved for any sample shape, any type of preparation, and any analytical ask.

In other words, a mass spectrometer with a UV laser system is proposed which, with very low energy losses, produces not only a single spot on the sample but also spatially distributed spot patterns with intensity peaks of approximately the same height, thus making it possible to achieve an optimum degree of ionization for analyte ions for any analytical task and kind of sample preparation. A spot pattern with intensity peaks of approximately the same height can be generated from a Gaussian profile of a UV beam from a solid state laser, for example, using a combination of a (particularly two-dimensional) lens array and a lens, provided that the lens array satisfies a mathematical condition for lens separation width (pitch) and focal length. A lens array with square lenses produces a pattern of nine spots, for example, while a lens array with round lenses produces a pattern of five spots. Lens arrays which do not obey this mathematical condition produce spot patterns whose peaks have a distinctly uneven intensity and are thus unsuitable for the application. The lens arrays are inexpensive compared to diffractive optical systems and do not require any lateral adjustment.

Figure 1:
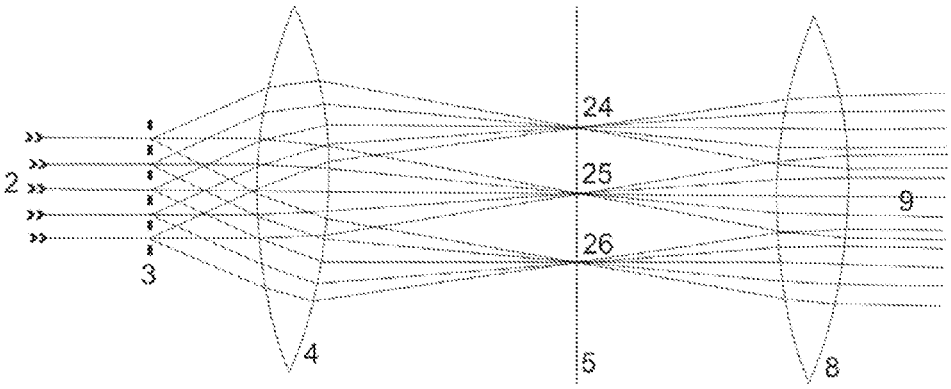
FIGURE 1 (PRIOR ART)
FIG. 1 depicts how a spot pattern (24, 25, 26) is generated from a Gaussian laser beam (2) with high lateral coherence. The laser beam (2) here is first split into parallel beams of minus n-th to plus n-th order by a periodic arrangement of diffractive or refractive elements (3).

As is shown in FIG. 1, it is possible to use interferences to generate a spot pattern from the natural Gaussian profile of an UV beam (2) from a solid state laser using a combination of periodically arranged refractive or diffractive elements (3) and an imaging lens (4), which is often called a Fourier lens due to its function. Only the central spots (24) to (26) are shown in FIG. 1. However, the intensity peaks are not usually the same height, but have a strongly modulated envelope, which depends on the number of peaks. If lens arrays (3) with specific properties are used, however, a small number of prominent intensity peaks of the same height can be generated for all wavelengths, even in the ultraviolet range, and these peaks contain most of the beam energy. Patterns with nine and five prominent intensity peaks of approximately equal height are shown in FIGS. 4*a*, 4*b*, 5*a* and 5*b* as examples.

To generate the multitude of intensity peaks with the same energy density, it is necessary to essentially adhere to a specific form for the lens array and to meet a specific mathematical condition in at least one direction between the separation width p of the lenses of the array (pitch) and the focal length $f_A$ of the lenses: $f_A=c\ p^2/\lambda$, where c is an optimization constant, and $\lambda$ the wavelength of the radiation. A preferred, mathematically determined value of the constants is approximately one fifth, c=0.2067. Square lenses in a square array cause a weakening of the central intensity peak and a strengthening of the four intensity peaks in the corners of the field of nine spots; by a mathematical anomaly all nine intensity peaks become approximately the same height. Round lenses in a square arrangement generate five intensity peaks of equal height. The constant c=0.2067 in the equation $f_A=c\ p^2/\lambda$ applies to ideally spherical lenses of the array; depending on the real form of the lenses, the constant c can deviate upwards or downwards by up to ten percent.

The uniform pattern with several intensity peaks of equal energy density thus results from a hitherto unknown mathematical anomaly. To date, the generation of a spot pattern with intensity peaks of equal height is known only with two corresponding lens arrays in an arrangement known as a fly's eye. However, this arrangement produces large numbers of more than a hundred intensity peaks in each case in the ultraviolet, whereas it is preferable for the energy density of the laser light to be concentrated in only a few intensity peaks of almost homogeneous intensity, for instance, a number of less than twenty intensity peaks.

Figure 6:
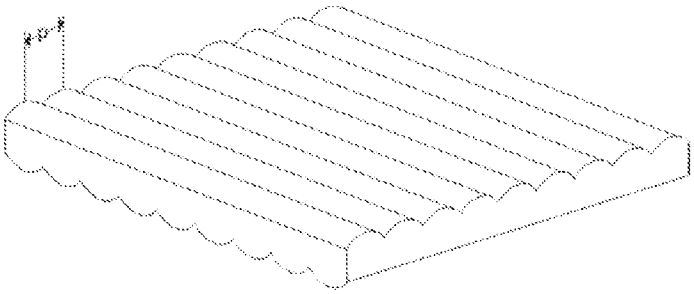
FIG. 6 illustrates a lens array with square lenses in a square arrangement, composed of crossed cylindrical lenses on the front and back faces, separated by pitch p.
Figure 7:
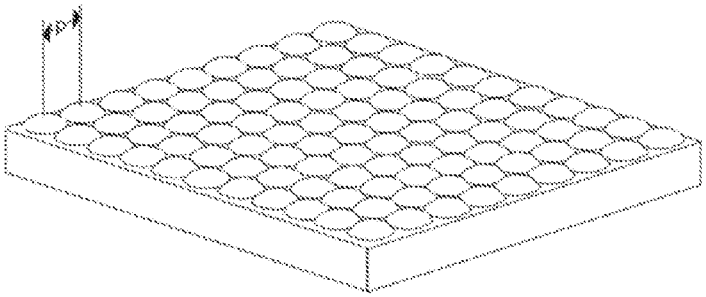
FIG. 7 depicts a lens array with circular lenses in a square arrangement, with pitch p.

A pattern of nine spots is produced from a lens array with square lenses in a square arrangement, for example; and a pattern of five spots from a lens array with round lenses in a square arrangement. A silica glass plate whose front and rear surfaces have the form of crossed cylindrical lenses, as shown in FIG. 6, can also be used as a (two-dimensional) lens array with square lenses, for example. A (two-dimensional) lens array with round lenses is shown in FIG. 7. There are low-cost manufacturing methods for these silica glass lens arrays, see for example "Design, fabrication and testing of microlens arrays for sensors and microsystems", Ph. Nussbaum et al., Pure Appl. Opt. 6 (1997) 617-636.

It seems entirely possible that other numbers of intensity peaks of equal height can be generated with other shapes and arrangements of lens arrays, such as triangular lenses or hexagonal lenses in a honeycomb arrangement, or with a linear or one-dimensional lens array, if specific ratios $f_A=c\ p^2/\lambda$ are adhered to. The constant c may have to be determined again mathematically or experimentally, depending on the modified geometry of the lens array.

Lens arrays with different lens separation widths p in the array in one direction result in spot patterns with different spot separations A in the corresponding direction according to the equation: $A=\lambda f_L/p$, where $f_L$ is the focal length of the Fourier lens. The larger the pitch p, the smaller the separation A of the spots becomes. The diameters $Ø_S$ of the spots at a height $1/e^2$ is determined by $Ø_S=1.22\lambda\ f_L/Ø_{UV}$, where $Ø_{UV}$ is the diameter of the UV beam illuminating the lens array. The diameter of the UV beam, which has a Gaussian profile, for example, is also given as a diameter at $1/e^2$ of the maximum intensity.

A lens array (3) with a pitch of p=170 μm generates a pattern of three times three peaks of approximately equal height from a UV beam (2) with a diameter of $Ø_{UV}$=1.7 mm, where the ratio of spot diameter to spot separation is 1:8. This pattern can be projected onto the sample, enlarged or reduced in size; it is, for example, possible to generate a pattern on the sample which has spot diameters of $Ø_S$=4 μm in each case for spot separations of A=32 μm. Such a pattern is ideal for scanning a single pixel of around 100 by 100 micrometers square in imaging mass spectrometry with a multitude of laser shots to get high quality mass spectra with high dynamic measuring range. By laterally shifting the spot pattern eight times, by four micrometers each time, eight individual spectra can be obtained. This procedure can be repeated eight times by shifting perpendicular to the first direction of shift; the result is 64 individual spectra. If the sample allows 4 individual spectra to be acquired at one position before the sample is consumed, the result is 256 individual spectra per pixel. If the spaces in the corners between the used circular sample holes are also utilized, it is possible to obtain 512 individual spectra for a sum spectrum of the pixel measuring 100 by 100 micrometers square: this procedure results in a mass spectrum with an outstandingly high dynamic measuring range. Since 20 pixels can be scanned per second at an acquisition rate of 10,000 spectra per second, the acquisition of all 10,000 sum spectra of a square centimeter thin tissue section takes only around eight minutes.

A larger pitch allows patterns with smaller separation to be generated, for example with separations A=17 μm or A=8 μm, for the scanning of smaller pixels with 50 or 25 micrometer edge length in order to acquire high-resolution mass spectrometric images, but then with lower dynamic measuring range.

By axially shifting lenses in the optical beam path, the intensity peaks can be imaged so as to be out of focus, making it possible to increase the diameters $Ø_S$ of the intensity peaks as desired. Special analytical tasks, or special sample preparations, may require such signal peaks with larger diameters. If the intensity peaks are made to be so out of focus that they overlap, interferences form a pattern with a large number of more than twenty intensity peaks, which can also be used for special analytical procedures.

Figure 2:
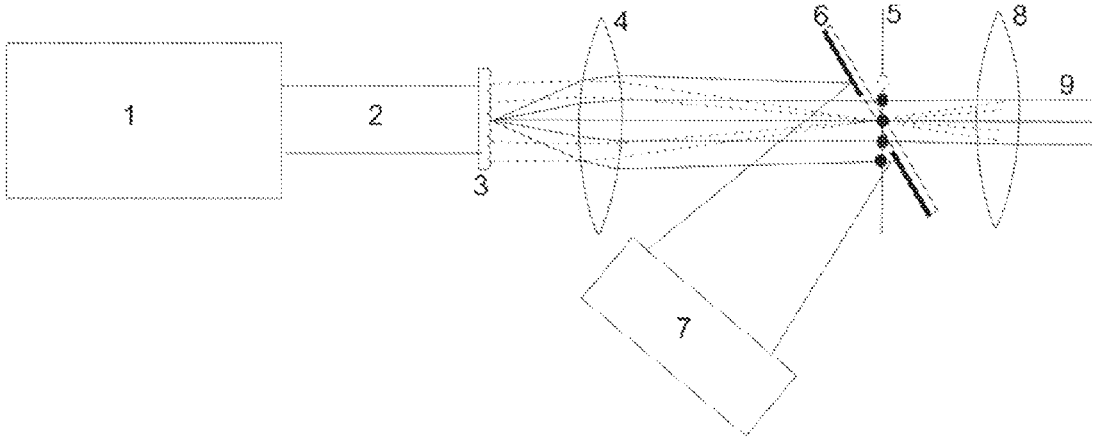
FIG. 2 shows how the spot pattern outside the desired spots can be removed using a partially mirror-coated silica plate, for example. As in FIG. 1, the signal pattern is generated in the plane (5) from the laser beam (2) of laser (1), by means of the periodic arrangement of elements, which is represented here as a two-dimensional lens array (3), and the Fourier lens (4). If a specific mathematical condition is fulfilled between the pitch of the lens array (3) and the focal length of the lenses of the array (3), then several central signal peaks have a prominent, equally high intensity. In order to mask the outer signal peaks, a partially mirror-coated silica glass plate (6) with a square transmission opening in the mirroring can be placed in the plane (5) of the signal peaks, for example. This plate guides the outer beams to an energy absorber (7). The lens (8) converts the beams from the intensity peaks of the plane (5) into a slightly structured parallel beam (9), with which ultimately the pattern of intensity peaks is transferred onto the sample in the ion source of the mass spectrometer.

In a particular embodiment of the invention, the mass spectrometer comprises a solid state laser system (1) as in FIG. 2, which provides a pulsed UV laser beam (2) with Gaussian profile, a lens array (3) with special dimensions, which is illuminated by the UV beam (2), and a lens (4), which produces the spot pattern in the plane (5). A partially mirror-coated silica glass plate (6) can mask the outer edges of the spot pattern by reflection so that the remaining beam energy can be removed in a beam absorber (7).

The adjustment of the lens array (3) is not critical. If the lens array (3) is shifted laterally, there is no change in either the position or the intensity distribution of the pattern in the plane (5), which is created by interference. It is thus possible for different types of lens arrays (one-dimensional or two-dimensional), creating different types of patterns and different signal peak separation widths A, to be moved or tilted into the beam path without making special demands on the precision of the lens array position.

The pattern with the central intensity peaks of almost equal height is surrounded by further intensity peaks, although their amplitude is lower by a factor of three at least. They play no part in the MALDI process, because their strong nonlinearity means that they contribute much less than a thousandth to the ion formation. They do, however, melt spots of the sample and vaporize small quantities of material. It is therefore favorable to mask the beams for these edge spots, as is illustrated in FIG. 2. More than 60% of the total energy of the laser beam is in the prominent intensity peaks of the pattern. The spot pattern with intensity peaks of the same height achieves an outstandingly high degree of ionization for analyte ions and extremely low sample consumption.

Figure 3:
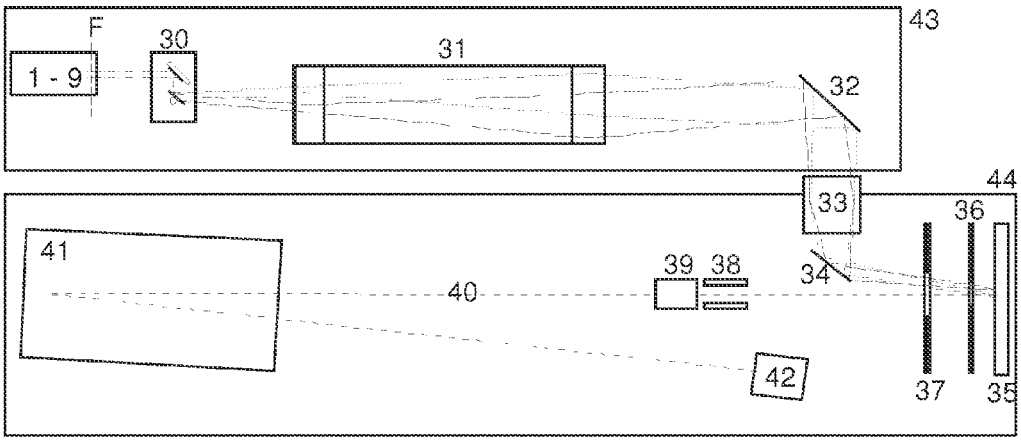
FIG. 3 shows how the assembly (1-9) of all the optical elements (1) to (9) of the laser system from FIG. 2 is schematically integrated into an extended laser system (43), which is connected to a MALDI time-of-flight mass spectrometer (44). This special extension (43) of the laser system allows the position of the laser light pattern on the sample support plate (35) to be controlled by means of a mirror system (30). The parallelized UV laser beam with structured profile can be deflected slightly in both spatial directions in the mirror system (30) with two galvo mirrors. The deflected laser beam is then expanded in a Kepler type telescope (31) and shifted parallel in accordance with the angular deflection. The mirror (32) directs the exiting laser beam exactly centrally into the object lens (33) again, with reduced angular deflection. Depending on the angular deflection, the beam passes through the object lens (33) centrally, but at slightly different angles, thus shifting the position of the spot pattern on the sample support plate (35). The ions generated in the plasma clouds of the laser spot pattern are accelerated by voltages at the diaphragms (36) and (37) to form an ion beam (40), which passes through two deflection capacitors (38) and (39), which are rotated by 90° with respect to each other, in order to correct the ion beam trajectory. The ion beam then reaches the reflector (41), where it is reflected onto the detector (42). It should be noted here that the beam guidance within a Kepler telescope (31) is more complex, and the illustration does not reproduce it in real terms for reasons of simplicity. The illustration does, however, correctly reproduce the effect of the telescope on the laser light beam, as seen from outside.
Figure 4A:
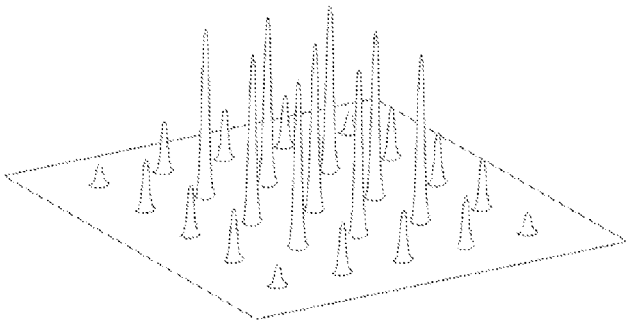
FIG. 4*a* depicts a laser spot pattern with nine prominent laser spots of approximately equal energy density in a three-dimensional view. The separations between the spots here have been chosen so as to be approximately eight times the size of the spot diameters, but it is easily possible to generate patterns with other separations and spot diameters. The nine spots contain more than 60 percent of the total energy of the laser beam. The less intense spots outside the nine prominent ones do not supply any ions; should these spots interfere, they can be masked, as is shown in FIG. 2.
Figure 4B:
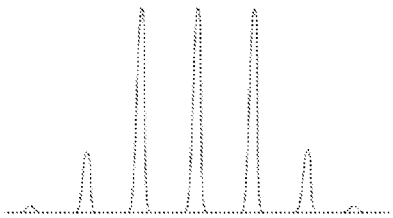
FIG. 4*b* depicts a cross-section through the energy densities in the center of the spot pattern.
Figure 5A:
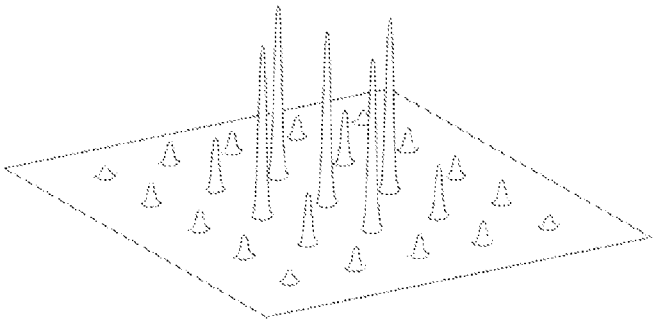
FIG. 5*a* shows a three-dimensional view of a laser spot pattern with five prominent high spots; a cross-section though the energy densities can be seen in FIG. 5*b*.
Figure 5B:
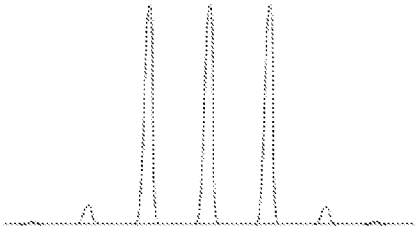

As is shown in FIG. 3, in the extended part of the laser system, the embodiment contains a galvo mirror system (30) in order to finely shift the spot pattern on the sample support (35) in both lateral directions. The parallelized UV laser beam with structured profile can be slightly deflected for this purpose in both spatial directions in the rotating mirror system (30) with two galvo mirrors. The deflected laser beam is then expanded in a Kepler type telescope (31) and shifted parallel in accordance with the angular deflection. The mirror (32) directs the exiting laser beam exactly centrally into the object lens (33) again, with reduced angular deflection. Depending on the angular deflection, the beam passes through the object lens (33) centrally, but at slightly different angles, thus shifting the position of the spot pattern on the sample support plate (35). Details of this have already been given in the documents referenced above and are included herein by reference.

As has already been explained in the introduction, in order to maximize the ion yield the degree of ionization for the analyte molecules is to be increased, but at the same time the number of fragmentations of the ions is to be limited for most types of analytic procedures, and this applies to both spontaneous fragmentations as well as to fragmentations of metastable ions during the flight through the mass spectrometer. The formation of metastable ions can be limited by using short laser pulses of around three nanoseconds at most. To prevent spontaneous fragmentations, the energy density must be limited. Furthermore, it is necessary to ensure that not more than a few thousand analyte ions are generated per laser shot in order to prevent the ion detector system from being saturated.

The prerequisites for the simultaneous fulfillment of these different conditions are not completely known; it has been found, however, that a pattern of five spots or nine spots, each five micrometers in diameter, comes very close to an optimum for the most widely used methods of preparing the matrix layers and for most analytical goals. Other patterns occasionally need to be selected for other types of preparation or for other analytical goals. By moving or tilting the (one-dimensional or two-dimensional) lens array out of the beam path of the UV laser light, it is possible to generate a single spot; and spot patterns of more than twenty spots can be generated by making the intensity peaks so out of focus that they overlap. The yield of analyte ions can probably be increased, with the aid of suitable patterns, to around one percent of the analyte molecules and more, i.e., to around one hundred times the yield of the conventional MALDI method.

Special analytical goals may require specific spontaneous fragmentations (for in-source decay, ISD), or high proportions of metastable ions (for daughter ion spectra with post-source decay, PSD), for example, but these can also be set with the laser systems described here.

This laser system for a MALDI mass spectrometer is advantageous not only because of its energy savings and its high yield of analyte ions. It is also particularly advantageous because the formation of the pattern with very small spots also suppresses the splashing of liquefied matrix material or the flaking-off of large pieces of solid material caused by the high recoil during vaporization, which additionally saves sample material. Especially when measuring a very large number of samples per unit of time, as is made possible with high pulse frequency lasers in MALDI-TOF mass spectrometers, the reduced contamination of the ion lens is an enormous advantage. A further advantage is also that the front of the adiabatically expanding plasma clouds of the pattern accelerates the ions predominantly into the flight direction of the time-of-flight mass spectrometer.

Different types of mass spectrometer may be used for the invention. The analyte ions produced with the laser system can preferably be detected and analyzed in a special MALDI time-of-flight mass spectrometer with axial ion injection, as shown schematically in FIG. 3. But it is also possible to feed the analyte ions to other types of mass analyzer for analysis, such as time-of-flight mass spectrometers with orthogonal ion injection (OTOF-MS), ion cyclotron resonance mass spectrometers (ICR-MS), radio frequency ion trap mass spectrometers (IT-MS) or electrostatic ion trap mass spectrometers of the Kingdon type, for example.

The invention has been shown and described with reference to a number of different embodiments thereof. It will be understood, however, that various aspects or details of the invention may be changed, or various aspects or details of different embodiments may be arbitrarily combined if practicable, without departing from the scope of the invention. Furthermore, the foregoing description is for the purpose of illustration only, and not for the purpose of limiting the invention, which is defined solely by the appended claims.

The invention claimed is:

1. A mass spectrometer with a laser desorption ion source, comprising a laser system for the pulsed ionization of a sample by matrix-assisted laser desorption, and a pattern generator for the generation of a spot pattern in the UV laser beam supplied by the laser system, wherein the pattern generator has a lens array, which spatially modulates a profile of the UV laser beam using a periodic phase, and an imaging lens, which subjects the modulated UV laser beam to a Fourier transform, and the lenses of the lens array obey a ratio of pitch p of the lenses to each other in at least one direction and focal length $f_A$ in accordance with the equation $f_A=c\ p^2/\lambda$, c being a constant amounting to a value between 0.18 and 0.22 and $\lambda$ being the wavelength of the UV radiation so that the imaging lens produces a pattern of several intensity peaks of approximately equal height in its focal plane, thereby optimizing the ionization of the sample.

2. The mass spectrometer according to claim 1, wherein nine intensity peaks of approximately equal height are generated by square lenses in the array.

3. The mass spectrometer according to claim 1, wherein five intensity peaks of approximately equal height are generated by circular lenses in the array.

4. The mass spectrometer according to claim 1, wherein the constant c in the equation $f_A=c\ p^2/\lambda$ amounts to a value of about 0.2.

5. The mass spectrometer according to claim 1, wherein the laser system generates a pulsed ultraviolet beam with a wavelength $\lambda$ in the range between 300 and 450 nanometers.

6. The mass spectrometer according to claim 1, further comprising an optical system having a telescope and object lens which images the spot pattern onto a sample to be ionized.

7. The mass spectrometer according to claim 6, further comprising a rotating mirror system between the pattern generator and the telescope, whereby the impact point of the laser light on the sample can be adjusted.

8. The mass spectrometer according to claim 1, wherein the laser system is designed to emit a sequence of laser light pulses with a pulse rate up to 10 kHz or more.

9. The mass spectrometer according to claim 1, wherein at least one pattern generator is coupled to a moving device, enabling it to be moved or tilted into the beam path of the UV laser light to create the spot pattern, and can be moved or tilted out of the beam path in order to allow the laser light beam to impinge on the sample without modification, or to be replaced by another pattern generator.

10. The mass spectrometer according to claim 1, wherein the laser system comprises a solid state laser that delivers a laser beam with substantially Gaussian profile.

11. The mass spectrometer according to claim 1, further comprising a translation stage that allows shifting the lens array in a direction of the laser beam.

12. The mass spectrometer according to claim 1, wherein the lenses of the array are arranged in one of one dimension and two dimensions.

13. The mass spectrometer according to claim 1, further comprising an aperture element in the laser beam path for masking out a low intensity rim of the spot pattern.

14. A method for the ionization of a sample by matrix-assisted laser desorption, MALDI, in a mass spectrometer with a laser desorption ion source, comprising a laser system for the pulsed MALDI ionization of a sample, and a pattern generator for the generation of a spot pattern in the UV laser beam supplied by the laser system, wherein the pattern generator has a lens array, which spatially modulates a profile of the UV laser beam with a periodic phase, and an imaging lens, which subjects the modulated UV laser beam to a Fourier transform, and the lenses of the lens array obey a ratio of pitch p of the lenses to each other in at least one direction and focal length $f_A$ in accordance with the equation $f_A=c\ p^2/\lambda$, c being a constant amounting to a value between 0.18 and 0.22 and $\lambda$ being the wavelength of the UV radiation so that the imaging lens produces a pattern of several intensity peaks of approximately equal height in its focal plane, thereby optimizing the ionization of the sample, wherein a sample containing analyte molecules is provided, and the analyte molecules are ionized using the spot pattern and measured mass spectrometrically.

* * * * *